US006513581B1

(12) United States Patent
Hüffer et al.

(10) Patent No.: US 6,513,581 B1
(45) Date of Patent: Feb. 4, 2003

(54) HEAT EXCHANGER WITH A REDUCED TENDENCY TO PRODUCE DEPOSITS AND METHOD FOR PRODUCING SAME

(75) Inventors: Stephan Hüffer, Ludwigshafen (DE); Axel Franke, Carlsberg (DE); Stephan Scholl, Bad Dürkheim (DE); Hans Mueller-Steinhagen, Hindhead Surrey (GB); Qi Zhao, Guildford Surrey (GB); Bernd Diebold, Fussgönheim (DE); Peter Dillmann, Insheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/869,275

(22) PCT Filed: Dec. 24, 1999

(86) PCT No.: PCT/EP99/10368

§ 371 (c)(1),
(2), (4) Date: Jun. 26, 2001

(87) PCT Pub. No.: WO00/40773

PCT Pub. Date: Jul. 13, 2000

(30) Foreign Application Priority Data

Dec. 30, 1998 (DE) ..... 198 60 526

(51) Int. Cl.[7] ..... F28F 19/02
(52) U.S. Cl. ..... 165/133; 165/134.1
(58) Field of Search ..... 165/133, 134.1

(56) References Cited

U.S. PATENT DOCUMENTS

| | | | | | |
|---|---|---|---|---|---|
| 3,753,757 | A | * | 8/1973 | Rodgers et al. | 427/183 |
| 4,064,914 | A | * | 12/1977 | Grant | 138/142 |
| 4,156,127 | A | * | 5/1979 | Sako et al. | 137/141 |
| 5,930,581 | A | * | 7/1999 | Born et al. | 419/12 |

FOREIGN PATENT DOCUMENTS

| | | | | | |
|---|---|---|---|---|---|
| EP | 0 737 759 | | 10/1996 | | |
| JP | 60-174454 | A | * | 9/1985 | 165/133 |
| JP | 63-280775 | A | * | 11/1988 | 165/133 |
| JP | 04-328146 | A | * | 11/1992 | 524/567 |
| JP | 05-017649 | A | * | 1/1993 | 524/567 |
| JP | 06026786 | | | 2/1994 | |
| JP | 6108287 | | | 4/1994 | |
| SU | 1671740 | | | 8/1991 | |
| WO | WO 97/16692 | | | 5/1997 | |

OTHER PUBLICATIONS

Riedel et al. "Funktionaelle Vernickelung" Chemie Abscheidung von Mehrstoffsystemen auf Nickelbasis (1989) pp. 230–237.

Tulsi "Electroless Nickel–PTFE Composite Coatings" Transactions of the Institute of Metal Finishing vol. 61 (1983) pp. 147–149.

Vargo et al. "Silane Refunctionalization of Radio Frequency Glow Discharge Hydrolysed ePTFE Membrane Surfaces" Polymer Material Science and Engineering, Proceedings of the ACS Division of Polymeric Materials Science and Engineering vol. 62 (1990) pp. 259–263.

Steinhagen "Problems and Costs due to Heat Exchanger Fouling in New Zealand Industries" Heat Transfer Engineering vol. 14, (1993) pp. 19–30.

* cited by examiner

*Primary Examiner*—Allen Flanigan
(74) *Attorney, Agent, or Firm*—Keil & Weinkauf

(57) ABSTRACT

The invention relates to a process for the production of a heat transfer device, which comprises electroless chemical deposition of a metal/polymer dispersion layer, in which the polymer is halogenated, on a heat transfer surface. The invention furthermore relates to a process for the production of a heat transfer device, wherein a metal/phosphorus layer with a thickness of from 1 to 15 $\mu$m is applied by electroless chemical deposition before application of the metal/polymer dispersion layer. The invention furthermore relates to a heat transfer device which can be produced by a process according to the invention, and to the use of a coating, produced by electroless chemical deposition of a metal/polymer dispersion layer, in which the polymer is halogenated, for reducing the tendency of the coated surfaces to accumulate solids from fluids, causing fouling.

15 Claims, 1 Drawing Sheet

Figure 1:
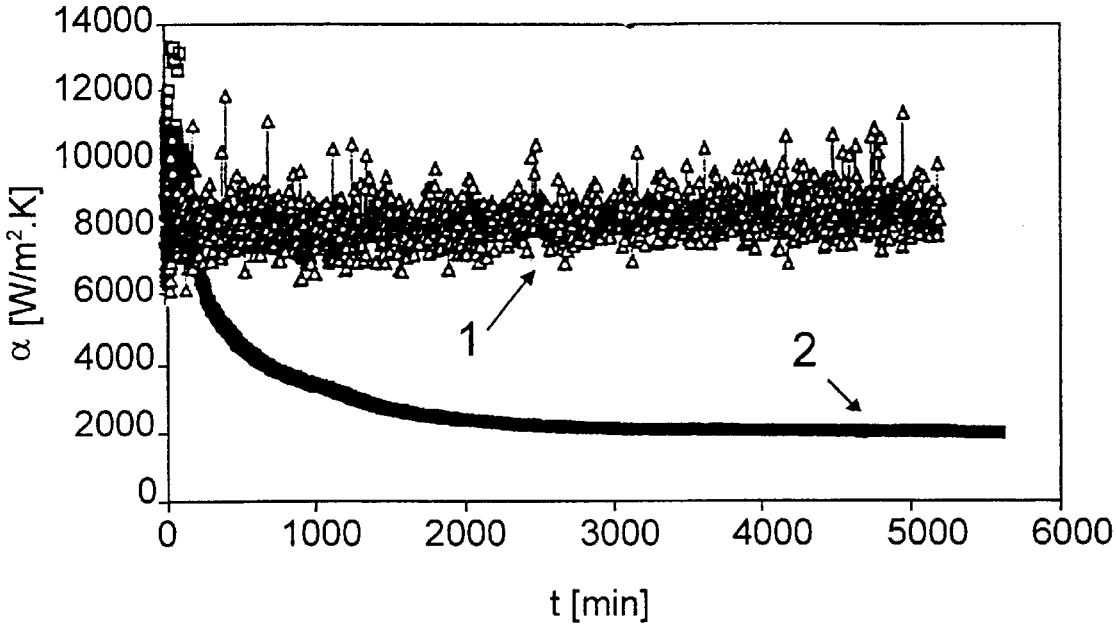

HEAT EXCHANGER WITH A REDUCED TENDENCY TO PRODUCE DEPOSITS AND METHOD FOR PRODUCING SAME

The present invention relates to a process for the production of heat transfer devices which comprises electroless chemical deposition of a metal/polymer dispersion layer. The present invention furthermore relates to heat transfer devices according to the invention. The present invention furthermore relates to the use of a metal/polymer dispersion layer as permanent encrustation inhibitor.

In recent decades, all branches of industry have suffered from fouling in heat transfer devices (Steinhagen et al (1982), Problems and Costs due to Heat Exchanger Fouling in New Zealand Industries, Heat Transfer Eng., 14(1), pages 19–30). When designing heat exchangers, increasing frictional pressure loss and heat-transfer resistance due to fouling must be taken into account. This results in overdimensioning of heat transfer devices by from 10 to 200%.

The development of anti-fouling methods has therefore taken on considerable importance.

Mechanical solutions have the disadvantage of being restricted to relatively large heat exchangers and in addition of causing considerable increased costs. Chemical additives can result in undesired contamination of the product and in some cases pollute the environment. For these reasons, ways of reducing the fouling tendency by modifying the heat-transfer surfaces have recently been sought. Although surface coatings with organic polymers, such as polytetrafluoroethylene (PTFE), reduce the fouling tendency, the known coatings themselves cause significant additional heat transmission resistance. At the same time, durability reasons mean that the layer thickness has a lower limit. Similar problems are also observed in methods which involve applying monolayer silane coatings to the surface to be protected (Polym. Mater. Sci. and Engineering, Proceedings of the ACS Division of Polymeric Materials Science and Engineering (1990), Volume 62, pages 259 to 263).

The problems associated with the use of polymer coatings do not occur in a process described in WO 97/16692. In this process, the hydrophobicity of the surface is increased by ion implantation or by sputtering methods. Although this results in a reduction in the fouling tendency, the use of this process, which always requires vacuum techniques, is, however, very expensive. In addition, the processes described are not suitable for coating poorly accessible or complex-shaped surfaces or components with a uniform layer.

The deposits whose formation is to be prevented are inorganic salts, such as calcium sulfate, barium sulfate, calcium carbonate and magnesium carbonate, inorganic phosphates, silicic acids and silicates, corrosion products, particulate deposits, for example sand (river and sea water), and organic deposits, such as bacteria, algae, proteins, mussles and mussle larvae, polymers, oils and resins, and biomineralized composites consisting of the above-mentioned substances.

It is an object of the present invention to indicate a process for the production of a heat transfer device which, on the one hand, reduces the tendency of the heat-transfer surfaces to accumulate deposits of solids, causing fouling, and which, on the other hand, results in negligible heat transmission resistance while having high stability (for example to heat, corrosion and underwashing). At the same time, the surfaces treated by the process should have satisfactory durability. The process should also be inexpensive to use on poorly accessible surfaces.

We have found that this object is achieved by a process for the production of a heat transfer device which comprises electroless chemical deposition of a metal/polymer dispersion layer, in which the polymer is halogenated, on a heat transfer surface.

For the purposes of the present invention, a heat transfer device is a device which has surfaces designed for heat exchange (heat transfer surfaces). Preference is given to heat transfer devices which exchange heat with fluids, in particular with liquids.

Heating elements and heat exchangers, in particular plate heat exchangers and spiral heat exchangers, are preferred embodiments of heat transfer devices.

A halogenated polymer is a fluorinated or chlorinated polymer; preference is given to fluorinated polymers, in particular perfluorinated polymers. Examples of perfluorinated polymers are polytetrafluoroethylene (PTFE) and perfluoroalkoxy polymers (PFA, in accordance with DIN 7728, Part 1, January 1988).

This solution according to the invention is based on a process for electroless chemical deposition of metal/polymer dispersion phases which is known per se (W. Riedel: Funktionelle Vernickelung [Functional Nickel Plating], Eugen Leize publishers, Saulgau, 1989, pages 231 to 236, ISBN 3-750480-044-x). A metal/polymer dispersion phase comprises a polymer, for the purposes of the present invention a halogenated polymer, which is dispersed in a metal alloy. The metal alloy is preferably a metal/phosphorus alloy.

The processes employed hitherto for preventing the encrustation tendency resulted in surfaces having greater roughness than electropolished steel (see Table 1). It is now been found that a coating which also reduces the roughness does the same job. In addition, it has been found that the effect of the polymer component in reducing the encrustation tendency is crucial, although the polymer content in the dispersion layer is rather low, at from 5 to 30% by volume.

In addition, it has been found that the surfaces treated in accordance with the invention facilitate good heat transfer, although the coatings can have a not inconsiderable thickness of from 1 to 100 $\mu$m. The surfaces treated in accordance with the invention furthermore have satisfactory durability, which also allows layer thicknesses of from 1 to 100 $\mu$m to appear appropriate; the layer thickness is preferably from 3 to 20 $\mu$m, in particular from 5 to 16 $\mu$m. The polymer content of the dispersion coating is from 5 to 30% by volume, preferably from 15 to 25% by volume, especially from 19 to 21% by volume. Furthermore, the coatings used in accordance with the invention are, as a result the process, relatively inexpensive and can also be applied to poorly accessible surfaces. These surfaces can be any desired heat transfer surfaces, such as internal surfaces of pipes, surfaces of electrical heating elements and surfaces of plate heat exchangers, etc., which are used for heating or cooling fluids in industrial plants, in private households, in food processing or in power generation or water treatment plants.

"Heat transmission" means the transfer of heat from the interior of the heat transfer device to any coating present on the fluid side, heat conduction within the coating layer, and heat transfer from the coating layer to the fluid (for example a salt solution).

In a preferred embodiment of the process according to the invention, the metal/phosphorus alloy of the metal/polymer dispersion layer is copper/phosphorus or nickel/phosphorus, preferably nickel/phosphorus.

In a further embodiment of the process according to the invention, the nickel/polymer dispersion layer is a dispersion layer of nickel/phosphorus/polytetrafluoroethylene. However, other fluorinated polymers are also suitable, such as perfluoroalkoxy polymers (PFA, copolymers of tetrafluoroethylene and perfluoroalkoxy vinyl ethers, for example perfluorovinyl propyl ether). If the heat transfer device is to be operated at relatively low temperature, the use of chlorinated polymers is likewise feasible.

In contrast to electrodeposition, the electrons required for chemical or autocatalytic deposition of the nickel/phosphorus are not provided by an external power source, but instead are generated by chemical reaction in the electrolyte itself (oxidation of a reducing agent). The coating is effected by dipping the workpiece into a metal electrolyte solution which has previously been mixed with a stabilized polymer dispersion. The dipping operation is preferably followed by conditioning at from 200 to 400° C., in particular at from 315 to 325° C. The conditioning duration is generally from 5 minutes to 3 hours, preferably from 35 to 45 minutes. Examples of metal solutions which can be employed are commercially available nickel electrolyte solutions containing $Ni^{II}$, hypophosphite, carboxylic acids and fluoride and, if desired, deposition moderators, such as $Pb^{2+}$. Such solutions are sold, for example, by Riedel, Galvano-und Filtertechnik GmbH, Halle, Westphalia, and Atotech Deutschland GmbH, Berlin. Polymers which can be used are, for example, commercially available polytetrafluoroethylene dispersions (PTFE dispersions). Preference is given to PTFE dispersions having a solids content of from 35 to 60% by weight and a mean particle diameter of from 0.1 to 1 $\mu$m, in particular of from 0.1 to 0,3 $\mu$m, wherein the particles have a spherical morphology, and which contain a neutral detergent (for example polyglycols, alkylphenol ethoxylate or, if desired, mixtures of these substances, from 80 to 120 g of neutral detergent per liter) and an ionic detergent (for example alkyl- and haloalkylsulfonates, alkylbenzenesulfonates, alkylphenol ether sulfates, tetraalkylammonium salts or, if desired, mixtures of these substances, from 15 to 60 g of ionic detergent per liter). Typical dip baths have a pH of about 5 and contain about 27 g/l of $NiSO_4 \times 6\ H_2O$ and about 21 g/l of $NaH_2PO_2 \times H_2O$ with a PTFE content of from 1 to 25 g/l. The polymer content of the dispersion coating is affected principally by the amount of polymer dispersion added and the choice of detergents.

The present invention furthermore relates to a process for the production of a heat transfer device which has a particularly adherent, durable and heat-resistant coating and therefore achieves the object according to invention in a particular manner. This process is based on a process for the production of a heat transfer device which comprises electroless chemical deposition of a metal/polymer dispersion coating, in which the polymer is halogenated, onto a heat transfer surface.

This process additionally comprises applying a metal/phosphorus layer with a thickness of from 1 to 15 $\mu$m by electroless chemical deposition before application of the metal/polymer dispersion layer.

Electroless chemical deposition of a metal/phosphorus layer with a thickness of from 1 to 15 $\mu$m for improving adhesion is carried out by means of the metal electrolyte baths described above, but to which in this case no stabilized polymer dispersion is added. Conditioning is preferably not carried out at this time, since this generally has an adverse effect on the adhesion of the subsequent metal/polymer dispersion layer. After deposition of the metal/phosphorus layer, the workpiece is introduced into the dip bath described above, which, besides the metal electrolyte, also contains a stabilized polymer dispersion. The metal/polymer dispersion layer forms during this operation. This is preferably followed by conditioning at from 200 to 400° C., in particular at from 315 to 325° C. The conditioning duration is generally from 5 minutes to 3 hours, preferably from 35 to 45 minutes.

In a further embodiment of the process according to the invention, the metal/phosphorus layer has a thickness of from 1 to 5 $\mu$m.

In a further embodiment of the process according to the invention, the metal/phosphorus alloy of the metal/polymer dispersion layer and of the metal/phosphorus layer is nickel/phosphorus or copper/phosphorus.

In a further embodiment of the process according to the invention, the metal/polymer dispersion layer is a dispersion layer of nickel/phosphorus/polytetrafluoroethylene.

The invention furthermore relates to a heat transfer device which can be produced by a process according to the invention. The heat transfer device according to the invention is preferably produced using a process according to the invention.

In a further embodiment, the above-mentioned heat transfer device according to invention is designed for the transfer of heat to fluids, in particular to liquids. Suitable heating elements here are all those which transfer heat to fluids. Furthermore, heat exchangers, in particular plate heat exchangers and spiral heat exchangers, are preferred examples of such heat transfer devices.

The invention furthermore relates to the use of a coating produced by electroless chemical deposition of a metal/polymer dispersion layer, in which the polymer is halogenated, for reducing the tendency of the coated surfaces to accumulate solids from fluids, causing fouling. The fluids are preferably liquids. The fouling whose formation is prevented in accordance with the invention has already been described.

Figure 2:
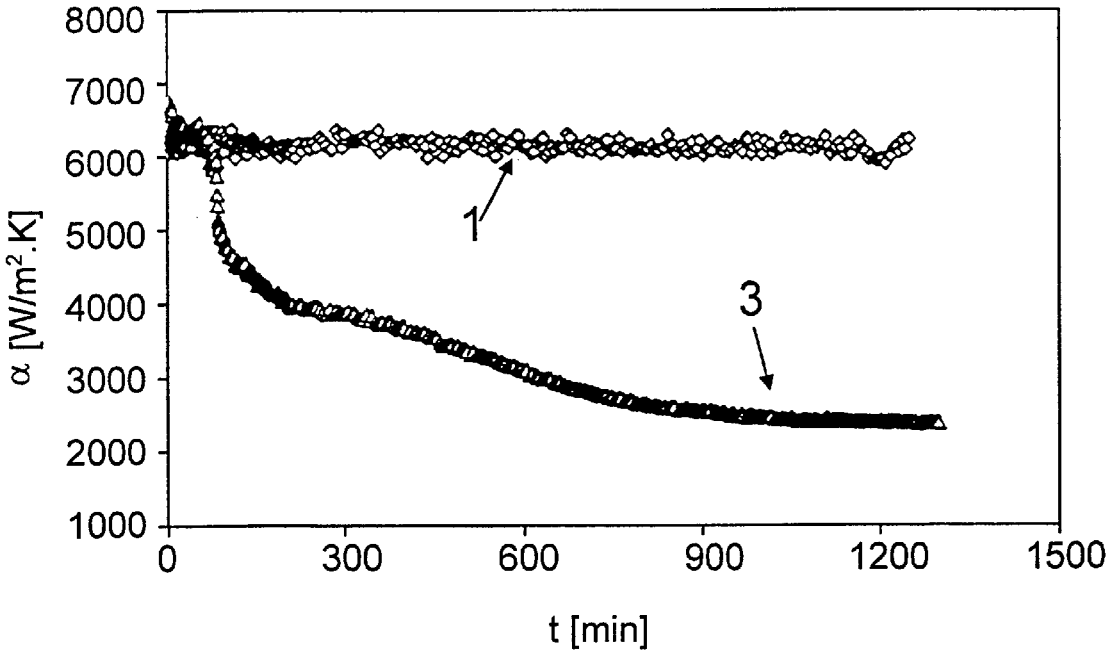

Some advantages of the heat transfer devices according to the invention or their coatings are indicated by the attached drawing, in which:

FIG. 1 shows the heat transfer coefficient through the boundary layer as a function of time, taking into account any coating layer present, on contact of various heat exchanger surfaces with a boiling salt solution, and FIG. 2 shows the heat transfer coefficient through the boundary layer as a function of time, taking into account any coating layer present, on contact of various heat exchanger surfaces with a warm stream of salt solution.

FIG. 1 shows the decrease in the heat transfer coefficient ($\alpha$ [W/m$^2$K]) due to $CaSO_4$ deposits as a function of time (t [min], abscissa) for various heat transfer devices which differ in the nature of their surfaces. Reference numeral 1 refers to the measured values of the coating according to the invention from the Example (*7). Reference numeral 2 denotes the measured values for an electropolished steel surface. The power per unit area is 200 kW/m$^2$, the concentration of the $CaSO_4$ solution is 1.6 g/l and the temperature corresponds to the boiling point.

FIG. 2 shows the measured decrease in the heat transfer coefficient ($\alpha$ [W/m$^2$K]) due to $CaSO_4$ deposits as a function of time (t [min], abscissa) for various heat transfer devices which differ in the nature of their surfaces. Reference numeral 1 refers to the coating according to the invention from the Example (*7). Reference numeral 3 refers to an untreated steel surface. The power per unit area of the heat transfer device is 100 kW/m$^2$. A $CaSO_4$ solution having a concentration of 2.5 g/l flows past the heat transfer device at a velocity of 80 cm/s and a temperature of 80° C.

Example

The advantages of the heating surfaces coated in accordance with the invention compared with uncoated heating surfaces, electropolished surfaces and ion-implanted or sputtered surfaces were determined in laboratory investigations. Table 1 contains a comparison of the measured values for surface roughness, surface energy and wetting angle of the heating surfaces investigated, and the relative decrease in the measured heat transfer coefficients within the first 100 hours of the experiment. It is apparent that the heat transfer devices according to the invention provide very low surface energy, a very large contact angle and very good heat transfer behavior.

TABLE 1

| | Surface energy [mJ/m$^2$] * | Contact angle [°] ** | Roughness, $\mu$m **** | $\alpha_{100}/\alpha_0$ *** |
|---|---|---|---|---|
| Untreated (steel) | 84 | 65 | 0.14 | 0.4 |
| Electropolished steel | 86 | 62 | 0.08 | 0.65 |
| Si-ion implanted steel *5 | 39 | 80 | 0.14 | 0.75 |
| F-ion implanted steel *5 | 37 | 82 | 0.14 | 0.9 |
| DLC-sputtered steel *6 | 36 | 85 | 0.13 | 0.85 |
| TiNF-sputtered steel *6 | 34 | 87 | 0.14 | 0.9 |
| Steel/Ni-PTFE *7 | 25 | 100 | 0.1 | 0.9 |

Table 2 shows the surface energy, contact angle and bacteria (Streptococcus thermophilus) deposited per unit area of the heat transfer devices according to the invention compared with the heat transfer devices of the prior art.

TABLE 2

| | Surface energy [mJ/m$^2$] * | Contact angle [°] ** | log10 cells/cm$^2$ *9 |
|---|---|---|---|
| Untreated (steel) | 84 | 65 | 5.7 |
| Electropolished steel | 86 | 62 | 5.5 |
| Si-ion implanted steel *5 | 39 | 80 | 4.9 |
| F-ion implanted steel *5 | 37 | 82 | 5.5 |
| DLC-sputtered steel *6 | 36 | 85 | 5.0 |
| CrC-sputtered steel *6 | 34 | 87 | 4.1 |
| Steel/Ni-PTFE *7 | 25 | 100 | 3.9 |

*Measurement by the method of A. J. Kinloch, Adhesion and Adhesives, Chapman & Hall, University Press, Cambridge, 1994

**Measurement by the method of K. K. Owens, J. of Appl. Polym. Sci. 13 (1969) 1741–1747

***Relative heat transfer coefficient after an operating time of 100 hours (by the method of Müller-Steinhagen et al., Heat Transfer Engineering 17 (1998), 46–63)

****Surface roughness, Ra in accordance with DIN ISO 1302

*5 Method as described by J. W. Mayer, "Ion Implantation in Semiconductors, Silicon and Germanium", Academic Press, 1970 (ISBN 75107563)

*6 Process for the application of diamond-like carbon DLC in accordance with GB-A 9006073

*7 Firstly, a chemically electroless nickel layer of 5 $\mu$m containing 8% of phosphorus was applied for improving adhesion by immersion in a chemically electroless nickel electrolyte solution. The Ni/phosphorus/PTFE dispersion coating was subsequently produced in a dip bath consisting of a mixture of a chemically electroless nickel electrolyte solution and a detergent-stabilized PTFE dispersion. The deposition of nickel/phosphorus/polytetrafluoroethylene was carried out at from 87 to 89° C., i.e. at below 90° C., and at a pH of the electrolyte solution of from 4.6 to 5.0. The deposition rate was 10 $\mu$m/h, and the layer thickness was 15 $\mu$m. The composition of the chemically electroless nickel electrolyte/PTFE solution is shown in Table 3.

TABLE 3

| | Concentration [g/l] | pH |
|---|---|---|
| $NiSO_4 \times 6H_2O$ | 27 | 4.8 |
| $NaH_2PO_2 \times H_2O$ | 21 | |
| $CH_3CHOHCOOH$ | 20 | |
| $C_2H_{5COOH}$ | 3 | |
| Na citrate | 5 | |
| NaF | 1 | |
| PTFE (50%) 8* | 2–50 | |

Chemically electroless nickel electrolyte solutions are commercially available (Riedel, Galvano- und Filtertechnik GmbH, Halle, Westphalia, and Atotech Deutschland GmbH, Berlin). After application of the nickel/phosphorus/PTFE layer, the workpiece was conditioned at 300° C. for 20 minutes. The polymer and phosphorus contents in the dispersion layer were 20% by volume of PTFE, corresponding to 6% by weight of PTFE, and 7% of phosphorus.

*8 The PTFE dispersions are commercially available. The solids content and mean particle size were 50% by weight and 0.2 $\mu$m respectively. The dispersion was stabilized by a neutral detergent (50 g/l of Lutensol® alkylphenol ethoxylate, 50 g/l of Emulan® alkylphenol ethoxylate, manufacturer of both detergents is BASF AG, Ludwigshafen) and an ionic detergent (15 g/l of Lutensit® alkyl-sulfonate, BASF AG, Ludwigshafen, 8 g/l of Zonyl® perfluoro-$C_3$–$C_8$-alkylsulfonate, Dupont, Wilmington, USA). The concentration FIGS. 2–50 g/l relates to the amount of dispersion solution added.

*9 The measurement was carried out by the method of H. Muller-Steinhagen, Q. Zao and M. Reiβ, "A novel low fouling metal heat transfer surface", 5th UK National Conference on Heat Transfer, London, Sep. 17–18, 1997. The cell culture is Streptococcus thermophilus.

We claim:

1. A process for the production of a heat transfer device for exchange of heat with fluids, wherein a) a metal/phosphorus layer with a thickness of from 1 to 5 $\mu$m is applied by electroless chemical deposition onto a heat transfer surface and b) a metal/polymer dispersion layer, win which the polymer is halogenated, is subsequently applied by electroless chemical deposition onto the metal/phosphorus layer, produced in step a), and said metal/polymer dispersion layer has a polymer content of from 5 to 30% by volume.

2. A process as claimed in claim 1, wherein the metal/phosphorus alloy of the metal/polymer dispersion layer and of the metal/phosporous layer is nickel/phosphorus or copper/phosphorus.

3. A process as claimed in claim 1, wherein the metal polymer/dispersion layer is a dispersion layer of nickel/phosphorus/polyetrafluoroethylene.

4. A process as claimed in claim 1, wherein the metal/polymer dispersion layer has a polymer content of from 15 to 25% by volume.

5. A process as claimed in claim 1, wherein the metal/polymer dispersion layer has spherical polymer particles having mean particle diameter of from 0.1 to 0.3 $\mu$m.

6. A heat transfer device for exchange of heat fluids containing a heat transfer surface, a metal/phosphorus layer with a thickness of from 1 to 5 $\mu$m being applied to said heat transfer surface, a metal/polymer dispersion layer, in which the polymer is halogenated, being applied onto said metal/phosphorus layer and a polymer content from 5 to 30% by volume within said metal/polymer dispersion layer.

7. A heat transfer device as claimed in claim 6, wherein the metal/phosphorus allay of the metal/polymer dispersion layer and of the metal/phosphorus layer is nickel/phosphorus or copper/phosphorus.

8. A heat transfer device as claimed in claim 6, wherein the metal/polymer dispersion layer is a dispersion layer of nickel/phosphorus/polytetrafluoroethylene.

9. A heat transfer device as claimed in claim 6, wherein the metal/polymer dispersion layer has a polymer content of from 15 to 25% by volume.

10. A heat transfer device as claimed in claim 6, wherein the metal/polymer dispersion layer has spherical polymer particles having a mean particle diameter of from 0.1 to 0.3 $\mu$m.

11. A process for reducing or preventing fouling of a surface, comprising coating the surface by electroless chemical deposition, first with a metal/phosphorous layer, and subsequently with a metal/polymer dispersion layer, in which the polymer is halogenated.

12. A process as claimed in claim 2, wherein the metal/phosphorus alloy of the metal/polymer dispersion layer and of the metal/phosporous layer is nickel/phosphorus.

13. A process as claimed in claim 4, wherein the metal/polymer dispersion layer has a polymer content of from 19 to 21% by volume.

14. A heat transfer device as claimed in claim 7, wherein the metal/phosphorus allay of the metal/polymer dispersion layer and of the metal/phosphorus layer is nickel/phosphorus.

15. A heat transfer device as claimed in claim 9, wherein the metal/polymer dispersion layer has a polymer content of from 19 to 21% by volume.

* * * * *

UNITED STATES PATENT AND TRADEMARK OFFICE

CERTIFICATE OF CORRECTION

PATENT NO. : 6,513,581 B1
DATED : February 4, 2003
INVENTOR(S) : Hueffer et al.

It is certified that error appears in the above-identified patent and that said Letters Patent is hereby corrected as shown below:

Column 6,
Line 42, “win which” should be -- in which --.

Signed and Sealed this

Twenty-fifth Day of March, 2003

JAMES E. ROGAN
*Director of the United States Patent and Trademark Office*